US008348770B2

(12) United States Patent
Hart

(10) Patent No.: US 8,348,770 B2
(45) Date of Patent: Jan. 8, 2013

(54) SCORING MACHINE

(76) Inventor: Jeffrey Shawn Hart, Brea, CA (US)

( * ) Notice: Subject to any disclaimer, the term of this patent is extended or adjusted under 35 U.S.C. 154(b) by 167 days.

(21) Appl. No.: 12/831,425

(22) Filed: Jul. 7, 2010

(65) Prior Publication Data

US 2012/0010002 A1 Jan. 12, 2012

(51) Int. Cl.
*A63B 69/00* (2006.01)
*A63B 69/02* (2006.01)

(52) U.S. Cl. ..... 463/47.1; 482/12

(58) Field of Classification Search ..... 482/12; 463/47.1

See application file for complete search history.

(56) References Cited

U.S. PATENT DOCUMENTS

| | | | | |
|---|---|---|---|---|
| 3,920,242 | A | 11/1975 | Reith et al. | |
| 6,612,968 | B1 | 9/2003 | Alvaro | |
| 7,285,061 | B2 | 10/2007 | Wagner | |
| 2006/0100022 | A1 | 5/2006 | Linsay | |
| 2006/0211541 | A1 | 9/2006 | Abbondanzio et al. | |
| 2006/0287126 | A1 | 12/2006 | Aisenbrey | |
| 2008/0084281 | A1 | 4/2008 | Huang | |
| 2008/0211683 | A1 * | 9/2008 | Curt et al. | 340/652 |
| 2008/0300071 | A1 | 12/2008 | Valaika | |

OTHER PUBLICATIONS

"SG 31 Owner's Manual", downloaded from Internet Archive from a page crawled on Jul. 19, 2006, available at <http://web.archive.org/web/20060719140228/http://www.absolutefencinggear.com/manuals/SG31.pdf>.*

Introducing the Virtual Scoring Machine, 20 Pages.

Rules for Competitions, 2006, Book 3. Material Rules, Copyright British Fencing, pp. 1-78.

VSM Adapter Assembly, 12 Pages.

* cited by examiner

*Primary Examiner* — David L Lewis
*Assistant Examiner* — Werner Garner
(74) *Attorney, Agent, or Firm* — Knobbe Martens Olson & Bear LLP

(57) ABSTRACT

A device for facilitating the scoring of a fencing match can include a box having first and second fencing cord inputs, an optional third input for connection of the fencing piste, a standardized general-purpose computer output, a power source, and a processing module. The processing module can be in communication with the inputs, outputs, and power source. Further, the processing module can be configured to iteratively apply power to at least a portion of the first fencing cord input and at least a portion of the second fencing cord input at different times. The processing module can also be configured to check for fencing-relevant completed circuits between the fencing cord inputs. Even further, the processing module can output raw data regarding the completed circuits through the standardized general-purpose computer output.

18 Claims, 5 Drawing Sheets

SCORING MACHINE

BACKGROUND

1. Field

The disclosure relates to scoring machines. More particularly, the disclosure relates to scoring machines for fencing.

2. Description of the Related Art

The sport of fencing includes three commonly-used weapons, each with unique rules. The first commonly-used weapon is the foil. Under standard rules, to score a hit with a foil the tip of the sword must contact an opponent within a target area generally defined by the opponent's upper torso, excluding the arms. To score a hit in épée, the tip of the sword may contact any part of the opponent's body. Finally, to score a hit in saber, the sword must contact the opponent above the waist (including the arms).

Unlike more traditional swords, modern sport fencing swords generally do not have sharpened tips or blades. However, these dulled blades do not leave a mark to evidence a successful hit. Thus, modern fencing swords often form electrical circuits with themselves and with other fencing accessories to indicate contact on-target and/or off-target. For example, in both foil and saber a conductive vest called a lamé is frequently worn over the on-target area. Thus, when a sword contacts an opponent's lamé, an electrical circuit can be closed between the sword and the lamé, indicating contact on-target. As another example, in foil and épée the sword can have a button at its tip. Pressing the tip against a target can close (in épée, traditionally) or open (in foil, traditionally) an electrical circuit passing through the sword, indicating that contact has been made with the tip.

SUMMARY

Some simple devices detect when such an electrical circuit occurs, and provide a simple display indicating the corresponding event. For example, some devices provide a single indicator light showing this status. Other devices also provide an audible sound indicating this status.

For various reasons, international governing bodies of fencing have also promulgated various rules for the required duration of contact to constitute a valid hit in fencing. Accordingly, devices have been configured to detect the duration of contact in compliance with these rules.

Unfortunately, the timing requirements of prior scoring machines cannot be modified by the user. Thus, when the international governing bodies recently altered the timing requirements, substantially all such devices around the world were no longer in compliance and had to be modified or replaced at substantial cost.

An improved scoring machine is described herein that in some embodiments improves upon the problems discussed above. In other embodiments, the improved scoring machine described herein provides other improvements including non-exclusively improved data-feedback, easy modification, modular design, and/or other features.

In one embodiment, a system adapted for scoring fencing matches can include a scoring machine and a computing device. The scoring machine can include a plurality of inputs configured to receive electrical signal corresponding to the state of sporting equipment representative of the performance of a first competitor. Further, the sporting equipment can include at least one electrical fencing sword. The scoring machine can also include a plurality of similar inputs for a second competitor. Additionally, the scoring machine can include a processing unit communicatively attached to the inputs to iteratively receive electrical signals corresponding to the state of the sporting equipment representative of the performance of at least one of the first and second competitors. The processing unit can also be configured to store a plurality of said iteratively received signals in a memory. The scoring machine can also have at least one data output configured to transmit said plurality of iteratively received signals as a single signal to a general-purpose computer. The computing device (which need not be a general-purpose computer) can be communicatively connected to the data output and receive said single signal. The computing device can be further configured to process said single signal and indicate an appropriate sport-relevant result.

In a further embodiment, a system adapted for scoring a fencing mach can also include a scoring machine and a computing device. The scoring machine can include a plurality of inputs configured to receive electrical signal corresponding to the state of sporting equipment representative of the performance of a first competitor. Further, the sporting equipment can include at least one electrical fencing sword. Additionally, the scoring machine can include a processing unit communicatively attached to receive one or more electrical signals corresponding to the state of the sporting equipment, and to process said signals into a standardized computer-readable format. The scoring machine can also include at least one data output configured to transmit said processed signals to a general purpose computer. The computing device (which need not be a general purpose computer) can be communicatively connected to the scoring machine and be configured to receive said processed signals and translate the signals into an appropriate sport-relevant result. Further, the scoring machine can be configured to receive electrical signals corresponding to the first competitor during a first time interval, and to receive signals corresponding to the second competitor during a second time interval distinct from the first time interval.

In a further embodiment, a device for facilitating the scoring of a fencing match can include a box having first and second fencing cord inputs, a standardized general-purpose computer output, a power source, and a processing module. The processing module can be in communication with the inputs, outputs, and power source. Further, the processing module can be configured to iteratively apply power to at least a portion of the first fencing cord input and at least a portion of the second fencing cord input at different times. The processing module can also be configured to check for fencing-relevant completed circuits between the fencing cord inputs. Even further, the processing module can output raw data regarding the completed circuits through the standardized general-purpose computer output.

In a further embodiment, a method of scoring a fencing match is provided. The status of a plurality of fencing-related circuits on a first scoring device can be iteratively monitored. The status can then be stored and a plurality of said statuses can be transmitted to a general-purpose computer in a single signal. The stored statuses can then be converted into a fencing-relevant result on the general-purpose computer. The results can also be displayed.

BRIEF DESCRIPTION OF THE DRAWINGS

Further objects, features and advantages of the invention will become apparent from the following detailed description taken in conjunction with the accompanying figures showing illustrative embodiments of the invention, in which.

DETAILED DESCRIPTION OF SOME PREFERRED EMBODIMENTS

Described herein are various preferred embodiments of scoring devices, systems, and methods. Although the scoring systems herein are described in the context of fencing, similar devices, systems, and methods can be used with other sports. Further, in some embodiments the devices, systems, and methods described herein can be modified for use in non-sporting contexts.

Figure 1:
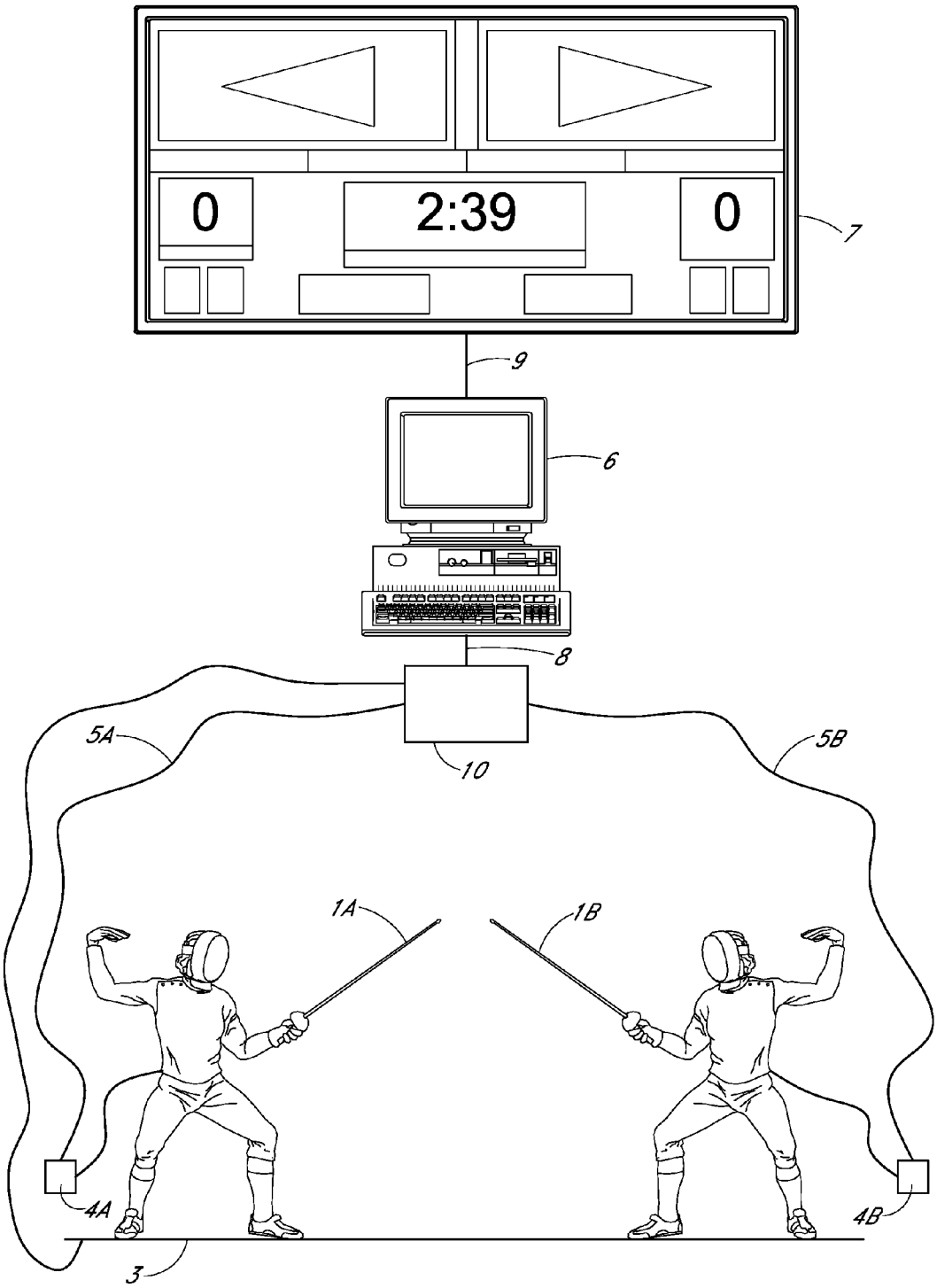
FIG. 1 is a demonstrative view of a fencing match using an embodiment of a scoring system.
Figure 2:
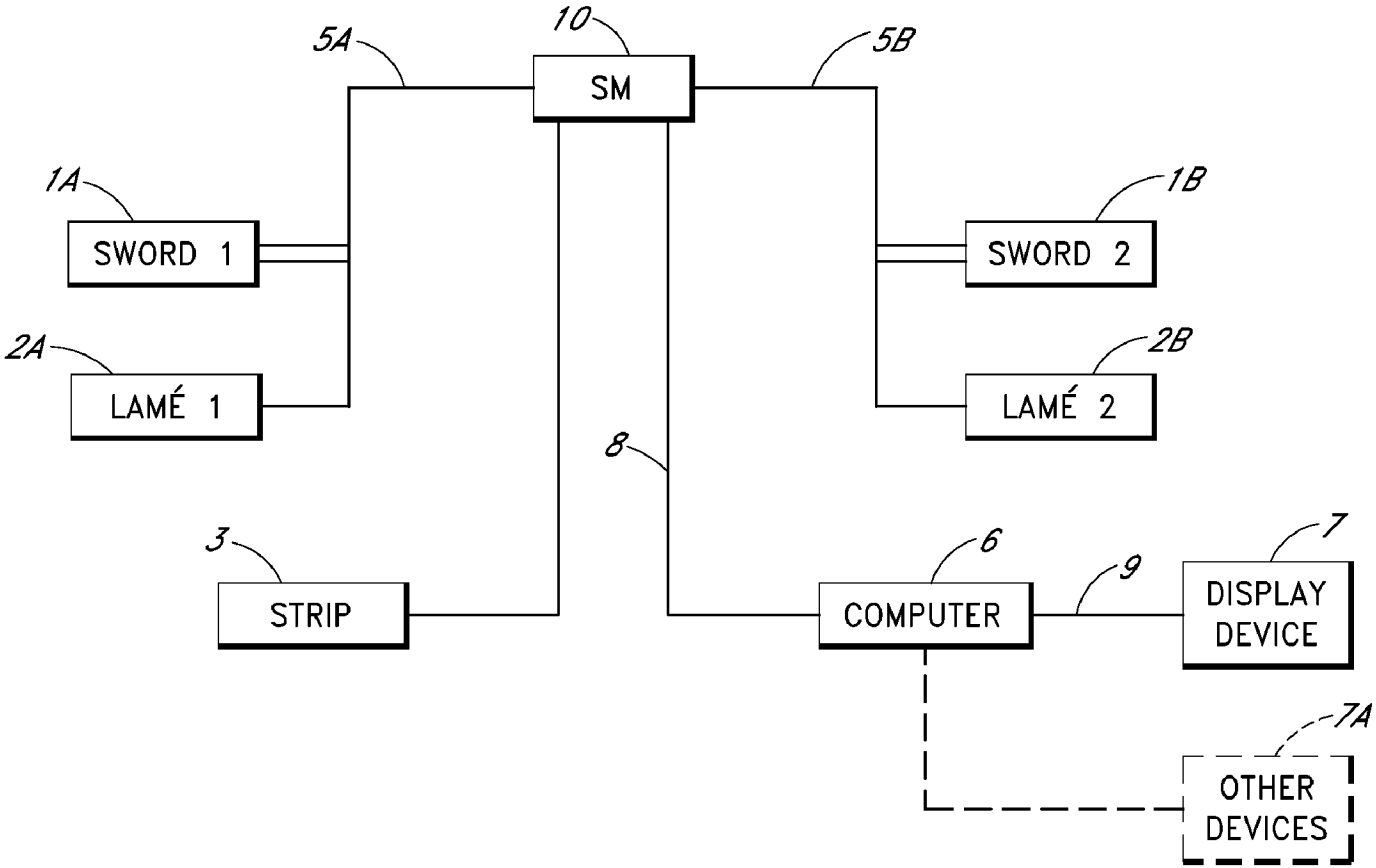
FIG. 2 is a block diagram of an embodiment of a scoring system that can be used in fencing.

FIG. 1 is a demonstrative view of a fencing match using a scoring system. As will be understood by those of skill in the art, the depicted competitors are using épée swords 1A, 1B, and thus no lamés 2A, 2B (depicted in FIG. 2) are shown. Further, as will be understood, the cords 5A, 5B connect only to the swords 1A, 1B on the competitors' ends of the cords, in accordance with standard épée fencing rules and equipment. The competitors are positioned on a fencing piste or strip 3 that is optionally in electrical communication with the rest of the system.

As further depicted, the cords 5A, 5B extend back from the competitors to their respective fencing reels 4A, 4B, which direct the cords to a scoring machine 10. The scoring machine 10 is depicted as having a data link 8 to a computing device 6 depicted as a general-purpose computer such as a PC. In other embodiments the computing device 6 can be another form of computing device such as a general-purpose computer 6, or more specifically a desktop, laptop, nettop, netbook, smartphone, personal digital assistant, server, video game console, or the like. More generally, the computing device 6 can be a machine that manipulates data according to a list of instructions or the like.

The data link 8 between the scoring machine 10 and the computing device 6 can be in the form of a standardized data transfer medium such as a Universal Serial Bus ("USB") cable, Ethernet cable, FireWire cable, or the like. In other embodiments the data link 8 can be provided through a wireless data connection provided by wireless radio, infrared signals, or the like. In some embodiments, the scoring machine 10 can be powered by a cable that also provides the data link, such as via a USB cable. In other embodiments, the scoring machine 10 can have a power source independent of the computer 6, such as a battery or an independent power cord.

The computing device 10 can further connect to a display 7. As depicted, the display 7 can be a wide screen monitor. In other embodiments the display 7 can be a video projector, a television, a computer monitor, an array of lights, or another form of display. Further, although the depicted computing device 6 has its own monitor distinct from the display 7, in other embodiments the display device can be the same as the computing device's own monitor, such as when the display is integral with the computing device. The display 7 can also include audio outputs in some embodiments, such as speakers, piezoelectric transducers, or the like. In further embodiments, the scoring machine 10 can include its own display and/or audio outputs.

The scoring machine 10 and its function will now be described in more detail. The scoring machine 10 can include one or more modules. In general the word "module," as used herein, refers to logic embodied in hardware and/or firmware, and/or to a collection of software instructions, possibly having entry and/or exit points, written in a programming language, such as, for example, Java, and/or the Java Platform-Micro Edition (Java ME, and/or J2ME), comprising the Java Specification Request 234 (JSR 234) Advanced Multimedia Supplements. Other programming languages comprise without limitation COBOL, CICS, Lua, C and/or C++ and an application program including pseudo code interpretable instructions. A software module may be compiled and linked into an executable program, installed in a dynamic link library, and/or may be written in an interpreted programming language such as, for example, BASIC, Perl, PHP and/or Python. It will be appreciated that software modules may be callable from other modules and/or from themselves, and/or may be invoked in response to detected events and/or interrupts. Software instructions may be embedded in firmware, such as an erasable programmable read-only memory (EPROM). It will be further appreciated that hardware modules may be comprised of connected logic units, such as gates and/or flip-flops, and/or may be comprised of programmable units, such as programmable gate arrays and/or processors. The modules described herein can be implemented as software modules or be represented in hardware and/or firmware. Generally, the modules described herein refer to logical modules that may be combined with other modules or divided into sub-modules despite their physical organization or storage. It will be understood that in some embodiment the actions of the computing device 6 are actually performed by modules embodied therein.

The scoring machine 10 can include a processing module in electronic communication with the fencing cords 5A, 5B. In some embodiments, the processing module can detect when a circuit has been completed between the fencing cords 5A, 5B and corresponding fencing equipment. For example, in épée fencing a hit can be indicated by depressing a button at the tip of one's sword 1. In some embodiments of épée swords 1, at least one wire from a fencing cord 5 can connect to a lower portion of the sword which is electrically connected to the upper portion of the sword 1. This electrical connection can be through an electrically conductive outer portion of the sword 1. Within the outer casing, the sword 1 can include an insulated wire connected to another wire of the fencing cord 5. The insulated wire can extend and form electrical contact with a movable tip of the sword 1. When the tip is not depressed, the tip and the outer portion of the sword can be electrically separated, and thus a circuit between them (and the corresponding fencing cord wires to which they connect) can be open. However, when the tip is depressed it can contact the outer portion and close the circuit.

The status of the circuit as open or closed can be detected by the processing module by applying a voltage across the two wires of the fencing cord 5. A lack of current passing through can form a logical "false", indicating that the circuit is open. However, a detected current passing through the circuit can form a logical "true", indicating that the circuit is closed. Thus, the processing module can determine if the tip is depressed. In other embodiments, a depressed tip can be detected by an open circuit, wherein the circuit can be closed when the tip is not depressed. Even further, in some embodiments the processing module can also detect if a circuit has been completed across swords 1A, 1B. For example, the module can detect if a circuit has been completed between the tip of sword 1A, the outer portion of sword 1A, and the outer portion of sword 1B. This can indicate, for example, if one competitor has only hit the bell-guard of an opponent's sword as opposed to the competitor's body.

In some embodiments, further variations can be made. For example, in some embodiments the competitors can compete while standing on a conductive piste or strip 3 that can also be electrically connected to the scoring machine 10. In this embodiment, the scoring machine can also check for a completed circuit between a sword 1 and the strip 3, indicating that a depressed tip hit the floor instead of an opponent, such as when a competitor attempts to hit his opponent's foot.

In further embodiments, the scoring machine 10 can interact with other fencing equipment. For example, in some embodiments the scoring machine 10 can interact with foil swords and equipment. The foil sword can be wired in manners substantially similar to the épée sword 1 described above. Further, in some embodiments the competitors can wear a lamé 2A, 2B (depicted functionally in FIG. 2). The lamés can cover particular target areas of the competitor's bodies. Further, the lamés can be electrically conductive and be electrically connected to a wire of a fencing cord 5 with an electrical connector such as an alligator clip.

In such an embodiment, the scoring machine 10 can detect a depressed tip in a substantially similar manner. Even further, the scoring machine 10 can detect when a depressed tip, or another part of the sword 1, is in contact with an opponent's lamé 2. Thus, a hit can be detected and be determined to be on- or off-target according to which circuits are completed.

In even further embodiments, the scoring machine can interact with saber swords and equipment. Differing from foil and épée swords, saber swords often do not have a depressible tip. However, like foil and épée swords, the saber sword can be electrically connected to a wire of the fencing cord 5. Further, like in foil, the competitor can also wear a lamé 2 that covers an appropriate target area and is connected to a wire of the fencing cord 5 in a similar manner.

In even further embodiments, the scoring machine 10 can interact with other fencing equipment such as non-standardized fencing equipment. Similarly, in some embodiments the scoring machine 10 can interact with equipment not related to the sport of fencing.

Figure 3:
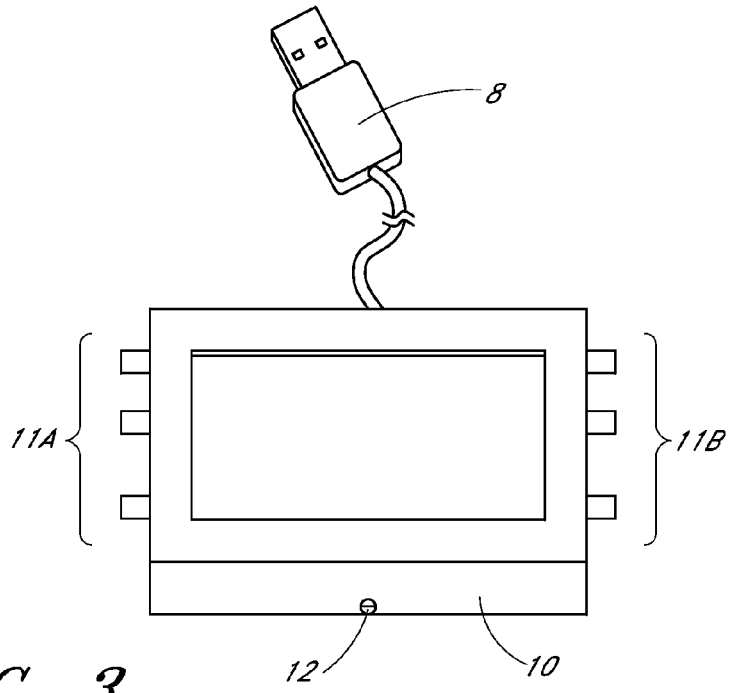
FIG. 3 is a perspective view of an embodiment of a scoring machine.

Physically, in some embodiments the scoring machine 10 can be in the form of a small, light-weight box. Optionally, the box 10 can be no larger than that necessary to hold a printed circuit board ("PCB") and the associated external electric connections. As depicted in FIG. 3, the box 10 can include two sets of fencing cord inputs 11A, 11B, each having three inputs arranged in accordance with standard fencing cords. The depicted box 10 further includes an outlet connector 12 configured to connect to a fencing strip 3 in a similar manner. Finally, the box 10 is depicted to include a data link 8 in the form of a USB cable, although other data links compatible with consumer computing devices and other computing devices can be used. In the depicted embodiment, the scoring machine 10, in the form of a box, has no additional inputs or outputs, nor any additional external features. In some embodiments, such a box can be less than approximately 50 cubic inches, less than approximately 35 cubic inches, or less than or equal to approximately 20 cubic inches. Further, in some embodiments the box can have dimensions of approximately 6¼×3½×⅞ inches. Further, in some embodiments the box can have a weight of less than approximately 20 ounces, less than approximately 15 ounces, or less than or equal to approximately 8 ounces. In further embodiments the scoring machine 10 can be smaller, such as in the form of a small card that can be installed inside a computer tower, case, or laptop drive.

As discussed above, the scoring machine 10 can connect to a general-purpose computer 6 such as a consumer computing device via the data link 8. In turn, the general purpose computer 6 can connect to a display 7 and/or other devices 7A. Further, the scoring machine 10 can, in some embodiments, provide a certain level of preprocessing of the collected data prior to transmission to an associated computer 6. In some embodiments, the scoring machine 10 can include certain safety elements such as opto-isolators to protect the scoring machine 10 and/or the general-purpose computer 6 from an unintentionally high static or stray voltage.

In operation, some embodiments of the scoring machine 10 can be configured to collect and transmit substantially raw data from the fencing equipment. For example, in some embodiments the scoring machine 10 is configured to only collect data regarding a simple status of the circuits (e.g. open or closed circuit). Further, in some embodiments the scoring machine 10 is unable to collect other data. In other embodiments, the scoring machine 10 can collect additional data including a more detailed status of the circuit, such as the strength of voltages, currents, and resistances across the circuits.

The scoring machine 10 can detect the status of the circuits, for example, by measuring the current or voltage at a given end of the possibly open circuit. Power can be applied to the other end of the circuit and thus a voltage and current will be induced at the other end if the circuit is closed. In some embodiments, this power can be applied only to one of the wires within each fencing cord 5. Thus, it may not always be possible to detect the status of every possible circuit. However, advantageously, this can still detect substantially all fencing relevant circuits.

For example, as discussed above, under standard rules for épée one is primarily concerned with whether the tip has been depressed. Accordingly, power can be applied to the wire corresponding with the tip and not to the outer portion of the blade. Thus, depression or extension of the tip can open or close the circuit, allowing the movement to be detected. As further discussed above, it can sometimes be desirable to also detect whether the blade has hit a fencing strip 3 or an opponent's bell guard, instead of the opponent himself. In such situations, the tip would contact said strip 3 or bell guard, which could then complete additional circuits with the tip. These additional circuits can be detected, indicating a hit off-target, with external power supplied only to the wire associated with the tip, now electrically connected to other pieces. In some embodiments, such off-target hits will not be displayed.

Similarly, in foil, these same hits can be detected. Additionally, as discussed above, in foil it can be desirable to see if the tip has contacted a lamé 2 (on-target) or another part of an opponent's body (off-target). As the opponent's lamé 2 can also form a circuit, this can also be detected with power applied only to the tip. In some embodiments, off-target hits can be displayed as distinct from on-target hits.

In saber, power can be supplied only to each competitor's sword (without depressible tips). Thus, circuits can be completed with lamés 2 or the strip 3 without power supplied to other wires. In some embodiments, electrical connections that may or may not exist between the swords of the two competitors can also be depicted.

In some embodiments of a scoring machine 10, the scoring machine can alternate between providing power to the tip or sword 1 of each competitor. This can advantageously avoid ambiguous circuit connections. For example, foil swords typically maintain a closed circuit between the tip and the outer portion, and the circuit is opened when the tip is depressed. Thus, no current would enter the outer portion of the sword when the tip is depressed. However, if power is applied to the swords of two competitors, and their outer portions are in contact when only one tip is depressed, power can still be detected in both outer portions. More specifically, the tip of sword 1A can be depressed and separated from the outer portion of sword 1A, depriving it of that power. However, the outer portion of sword 1A can contact the outer portion of sword 1B, which remains in contact with the powered tip of sword 1B. Thus, power can still be applied to the outer portion of 1A, masking the fact that the tip of sword 1A has been depressed.

In embodiments where the scoring machine 10 alternates between providing power to the tip or sword 1 of each competitor, such ambiguous situations can be substantially eliminated. In other embodiments, it may be desirable to distinguish between different completed circuits and combinations thereof by properties of the total circuit, such as the net resistance. For example, if resistors (including the internal resistances of the equipment) of different strengths are applied to various inputs/outputs of the scoring machine 10, then their combined resistances can be uniquely identified. However, this method of detecting fencing-relevant contacts can be disadvantageous where the associated fencing equipment has internal resistances that are less precisely set. It can often be preferable for a scoring machine 10 to work with a wide variety of equipment, personal to each competitor. Further, the resistance of the fencing equipment can vary with other factors, such as the point of contact on a lamé 2.

As also discussed above, in some embodiments the scoring machine 10 can collect the data regarding the circuits without substantial further processing. For example, in embodiments where the circuit is checked to be open or closed, the scoring machine 10 can indicate that as a logical "1" or "0," corresponding to the given circuit providing a predetermined threshold voltage, current, or the like. As will be discussed further below, maintaining the data in a substantially raw format can advantageously allow for the data to be interpreted in a variety of ways, comporting with different fencing rules and regulations.

Further, a plurality of such states can be stored in a memory module included within the scoring machine 10, such as on the PCB. In some embodiments this plurality of states can be stored in a manner that indicates their associated time. For example, in some embodiments the status of the circuits can be associated with a timestamp or a number indicative of a particular time. In other embodiments, a plurality of statuses can be stored in a sequence indicating their order, which can then implicitly indicate their associated time.

In embodiments where the scoring machine 10 stores a plurality of statuses, it can then transmit these statuses through the data link 8 to a general-purpose computer 6 in a single packet holding a plurality of statuses. Advantageously, this can allow the scoring machine 10 to acquire data from the fencing equipment at a rate faster than the computer 6 acquires data from the data link 8. This can be particularly advantageous when the general purpose computer 6 runs on a processor handling one or more other applications that may slow the computer. In such cases, the computer 6 might occasionally be unable to continuously process data from the data link 8, potentially resulting in lost data. Thus, in some embodiments, the scoring machine 10 can sample the status of the fencing equipment twice every millisecond, and transmit that data over the data link 8 in one packet once every 10 milliseconds. In other embodiments the data can be separated into more than one packet, be sampled at different rates, and be transmitted at different rates.

Figure 4:
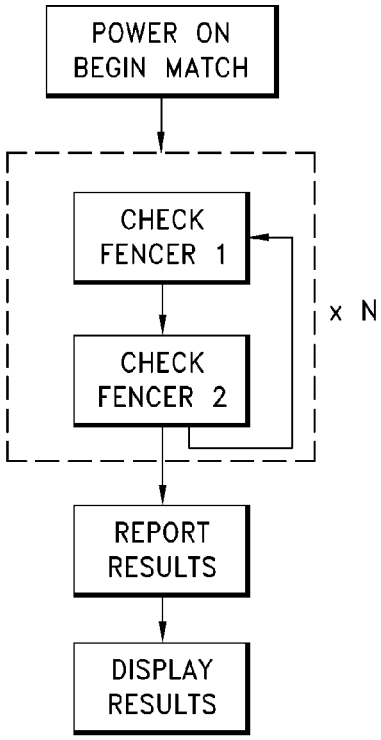
FIG. 4 is a flow chart of one embodiment of a scoring system.

The general purpose computer 6 can receive the statuses of the fencing equipment from the scoring machine 10. FIG. 4 depicts one embodiment of a method for scoring a match. First, power can be supplied to the general purpose computer 6, which can also provide power to the scoring machine 10 and the associated equipment. The competition can begin, and the scoring machine 10 can iteratively check the status of the fencing equipment for each competitor. As discussed above, this can be done in an alternating fashion, checking the equipment for one fencer at a time. For example, as described, power can be applied to the sword 1 of only one fencer at a time, with all circuits being checked for a connection to the powered sword. However, in other embodiments both fencers' swords 1 can be powered simultaneously and all connections can be checked simultaneously. Further, in some embodiments the circuits can be checked continuously instead of iteratively.

As depicted in FIG. 4, each fencer can be checked "N" times by the scoring machine 10 prior to the scoring machine reporting the results to the general purpose computer 6. Thus, for example, in some embodiments the scoring machine 10 can check the status of the circuits of each fencer 5, 10, 15, or 20 times prior to reporting the results to a computing device 6. The general purpose computer 6 can include a data processing module for translating the data from the scoring machine 10 into fencing relevant outcomes. Further, the general purpose computer 6 can include various output modules that can cause the results to be displayed, cause an audible sound indicating a result, cause a result to be recorded, or otherwise. In some embodiments the data processing module and the output modules can be implemented in software. However, in other embodiments the modules can be implemented in hardware, or hardware and software. For example, the data processing module can be implemented in software, while the output modules can be implemented as hardware or hardware and software or firmware.

Figure 5:
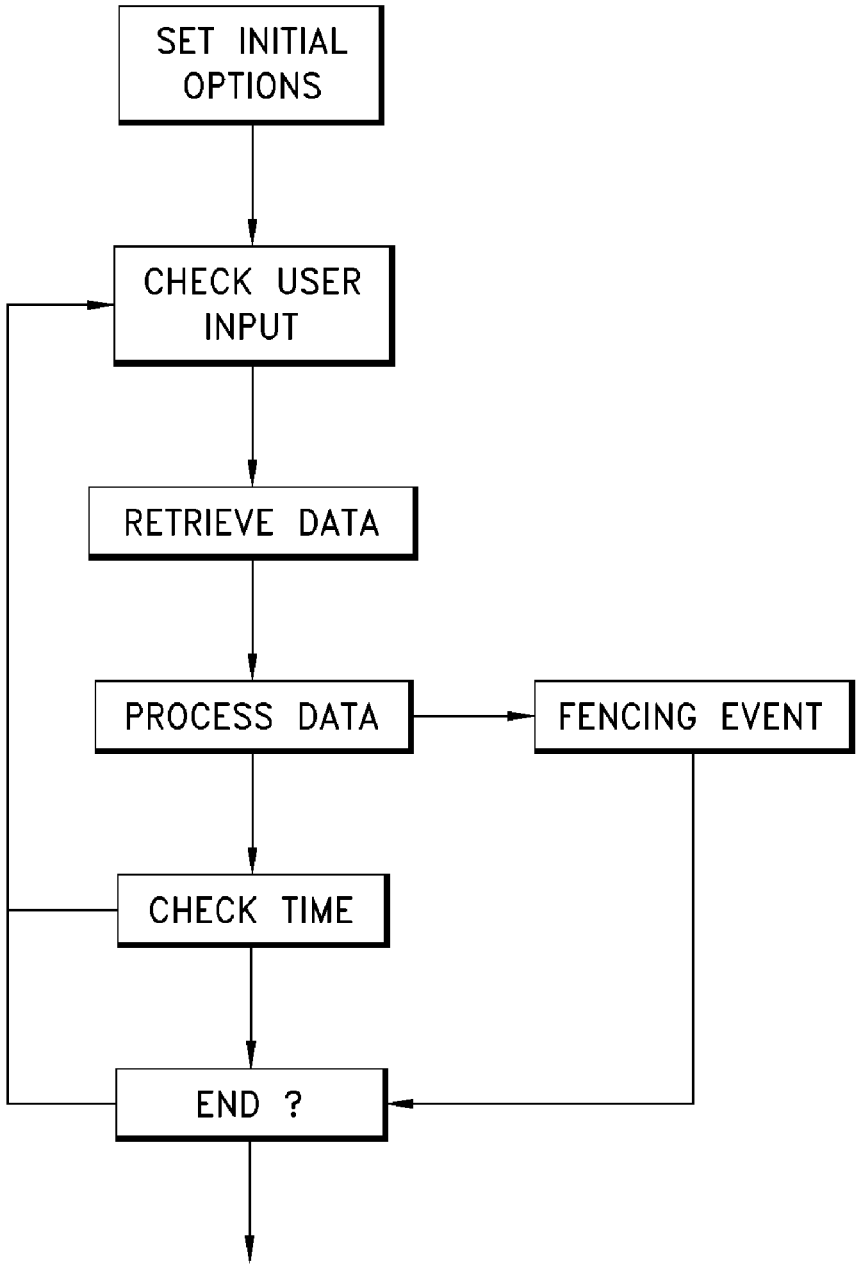
FIG. 5 is a flow chart of another embodiment of a scoring system.

FIG. 5 depicts another embodiment of a method for scoring a match. A user can set a wide variety of initial options for the rules of a match, the display of match results, recordation of the match results, format for a plurality of matches, the equipment used in the match, and other options. These options can provide a wide variety of advantages.

For example, in recent years international bodies have changed the definition of a successful hit in certain standard fencing weapons. More specifically, the length of time the tip of a foil sword must be depressed to count as a hit was increased to 14+/−1 milliseconds from approximately 2 to 5 milliseconds previously. Unfortunately, prior art devices did not allow significant changes to these time settings, rendering nearly all such devices obsolete and unusable regardless of the physical condition of their hardware. Advantageously, in some embodiments, the scoring machine 10 can output the statuses of the circuits in a substantially raw state, and data processing modules on the general purpose computer 6 can interpret said statuses in a plurality of ways, such as with optional requirements for the time of contact necessary for a legal hit. For example, software modules on the computing device 6 can determine where a completed circuit indicates a "hit" according to a variety of different rules. In one embodiment, if rules change the software modules can be updated by the users such that the scoring machine 10 need not be replaced to comply with the new rules. In further embodiments, the software modules can be programmable to make various rules and parameters customizable.

In further embodiments, the data processing modules can provide a variety of other optional settings. For example, the duration of contact required for a valid hit can be altered for other weapons such as épée and saber. Further, in some embodiments the time required to record an off-target hit can be set independently of the time required for an on-target hit. Other time-parameters can also be changed, such as timing related to blocking in saber, the time-limit for a bout, and the time limit in between hits required for a double-touch. Even further, in some embodiments the rules can be changed regarding non-timing related issues. For example, in standard rules the fencers stop after each off-target hit, with prior art devices also stopping and not recording subsequent on-target hits. Some embodiments of the scoring machine 10 and its associated computing device 6 can include the option to prevent this stoppage after an off-target hit (e.g. in a module on the computing device). Further, in some embodiments a competitor's ability to score an on-target hit can be temporarily disabled after an off-target hit. Even further, in some embodiments the data processing modules can allow two competitors to compete against each other using different swords.

Modules related to visual and audio displays can also be varied. For example, in some embodiments the sounds generated upon certain fencing events can be varied. Even further, in some embodiments users can set a general audio file on the computer 6 to play upon a given fencing event. Further, the module can allow substantial customization of a visual display. For example, certain text, indicative lights, and indicative symbols can be added/removed, made bigger/smaller, moved into different positions, and have other changes applied. Further, the modules can be configured to allow for multiple displays, optionally with different display parameters on each display.

Even further, the modules can be configured to display information not traditionally shown. For example, in foil where a touch is made without the adequate duration required for an on-target hit, the general-purpose computer 6 can include modules configured to display information related to the duration of the touch, such as how many milliseconds the touch lasted. Advantageously, this can indicate to the relevant competitor how close they were to a valid hit, and what changes could possibly be made to their technique to achieve valid hits. Similarly, the length of time between successive touches can be displayed, the length of time between a block and a hit, and the like.

In addition to the wide variety of initial options, other options can also be available in some embodiments of the modules on the general-purpose computer 6. For example, in some embodiments the computing device 6 can include modules that output the data to other devices, such as a main tournament scoring device or over the internet to a fencing result database. Further, if certain desired options are not available and the modules are provided as software, a software update can be provided including additional options.

Once the initial options have been set, as depicted in FIG. 5, a data processing module on the computer 6 can begin monitoring a match. Once the match begins, the computer 6 can receive at least two distinct forms of input. First, in some embodiments the computer 6 can receive input from a user via other input devices such as keyboards, mice, wireless devices (e.g. infrared, radio, Bluetooth, etc.), wired devices, internet connection, or the like. For example, if a match has a referee, the referee can input information using one of said devices. The modules on the computer 6 can be configured to respond to inputs from the referee, allowing the referee to temporarily start and stop the match, to award and remove points, to reset the match, or the like. Further, the inputs can also modify the visual and audio display options discussed above, before, during, or after a match. Other user inputs can also be included.

In addition to checking for user inputs, the modules on the computer 6 can retrieve data inputs from the scoring machine 10. As discussed above, this data can come in a variety of forms, such as in a packet containing the status of the fencing equipment, the packet being transmitted at, e.g., 10 millisecond time intervals. In some embodiments the status can be detected at half-millisecond time intervals, and a plurality of such statuses can be transmitted in a packet every 10 milliseconds. This data can then be processed, and it can be determined if a fencing-relevant event has occurred, such as an on-target or off-target hit. If no such event occurs, the computer 6 can check if time has expired, and if it hasn't it can loop back and continue checking for user inputs, retrieving data, processing data, and checking the time.

In the case that time expires or a fencing event occurs, the computer 6 can indicate this. Further, the computer 6 can determine whether the bout is completed. For example, it can check if either competitor has achieved the requisite points to win the bout. Further, in some embodiments multiple bouts can be done in sequence, such as in a team match. In such embodiments, the computer 6 can check if both a given bout is completed, and if all bouts in the team match are completed. If the bout and/or match is not complete, then the relevant modules can loop accordingly until completion.

Figure 6:
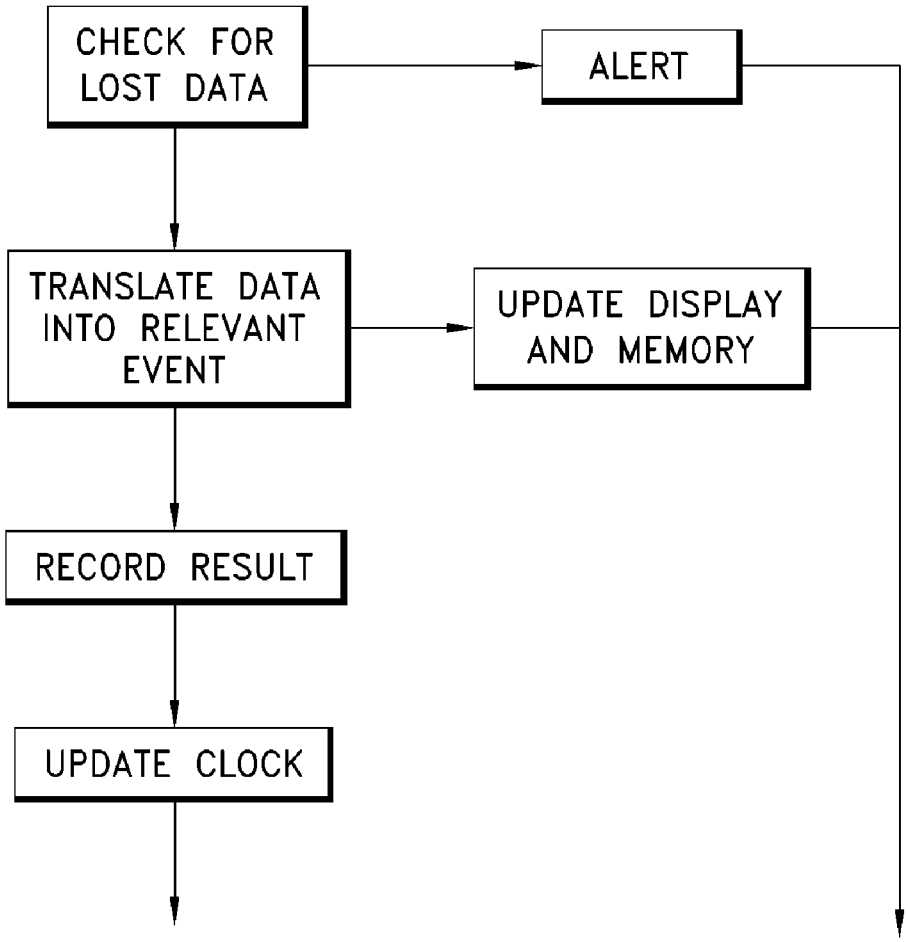
FIG. 6 is a flow chart of an embodiment of a module for processing data.

FIG. 6 depicts a more detailed embodiment of a module (or a plurality of modules) that processes data retrieved from an embodiment of a scoring machine 10. As shown, the module can first check for lost data such as an interval where a packet is not successfully transmitted from the scoring machine 10 to the computer 6. This can occur, for example, when there is a malfunction in the scoring machine 10 or in the computer 6. As discussed above, dropped packets could be common on a computer 6 running multiple applications. The potential for dropped packets can further be increased if, for example, software modules on the computer 6 are not given sufficiently high priority.

In some embodiments, the packets transmitted by the scoring machine 10 can be provided at regular intervals. Thus, if a packet does not arrive at a given time modules on the computer 6 can conclude that data has been lost. Further, in some embodiments the data transmitted from the scoring machine 10 can include a sequential marker, where each sequential marker is assigned to a sequential packet of data. Thus, for example, if the packets are marked numerically as: 1, 2, 3, 4, etc., then if the received packets are numbered: 1, 2, 4, 5, etc., it can be concluded that the #3 packet of data was lost. Other techniques can be used to detect lost data.

If data is detected as being lost, an alert can be provided to the user. This alert can be provided, for example, in the form of an audio or visual display. Further, in some embodiments this alert can be treated as a fencing-relevant event, where play is temporarily (or permanently) stopped. In other embodiments, play can continue under the assumption that no fencing event occurred during the time period covered by the lost data. In further embodiments, multiple such packets can be saved on the scoring machine 10, such that if a packet is lost then a module on the computing device 6 can cause the scoring machine 10 to resend a missing packet. Even further, in some embodiments the computing device 6 can transmit a message to the scoring machine 10 that a packet has been successfully transmitted, and the scoring machine 10 can then erase this packet from its memory.

If data was successfully transmitted then its processing can proceed. The computer 6 can translate the data into relevant events. Examples of such translations are loosely described above. For example, in épée fencing a hit can be indicated when power is applied to one wire in a sword 1 and is simultaneously detected (or not detected) in the other wire of the same sword (indicating that the sword's tip has been depressed, closing or opening a circuit). Thus, by receiving information related to the status of various circuits (such as the current, voltage, or other characteristics at one point along the circuit) the computer 6 can determine if a relevant event has occurred.

If such an event does occur, the computer 6 can proceed with a variety of different actions. For example, in the depicted embodiment the display 7 can be updated. Further, the event can be recorded to a memory that includes a variety of information regarding the match, such as the score, the time of each event, and the nature of such events. Even further, in some embodiments play can be stopped when particular fencing events occur. Also, in some embodiments play can continue when particular fencing events occur.

If no relevant event occurs (or if play will nevertheless continue) the results of the data can optionally be recorded to the memory also. These recorded events can later be played back, as will be discussed below.

Additionally, the computer's clock associated with the bout, match, or game can be updated to indicate the associated passage of time. As indicated in the embodiment of FIG. 5, the computer 6 can then proceed to check if time has expired, as discussed above.

Some embodiments of the scoring machine 10 and the associated modules on a computer 6 can provide even further features. For example, in some embodiments the computer 6 can include a playback module that allows a user to display the sequence of events in a bout after-the-fact. These events can be previously stored in a memory on the computer 6 (or elsewhere) with an indication of their time. Thus, they can be replayed with the appropriate timing. In further embodiments, this history of events can be viewed in text-format, timeline format, or in another format desired by a user.

Further, in some embodiments the scoring machine 10 and the associated modules on a computer 6 can automatically detect the equipment connected to the scoring machine 10. For example, in standard foil and saber swords, certain wires remain connected to each other by default, where the same wires are disconnected by default in épée. Thus, in some embodiments if said wires are connected an equipment detection module can detect the type of weapon used by monitoring the relevant completed circuits over an extended period of time. This can be especially advantageous in instances where a sound is provided upon a touch. The wires that remain connected by default in foil and saber indicate a hit when connected in épée. Thus, if these wires remain connected (or disconnected) for an extended period of time, the module can optionally assume that a corresponding weapon is being used. Many prior art devices, when set to score saber or foil, will indicate continuous hits when an épée is connected. Unfortunately, this often results in a continuous sound (indicating the incorrectly detected hit) which continues indefinitely until the settings for the device are changed. The same continuous sound can occur if no equipment is connected. This problem can advantageously be avoided in some of the embodiments.

In further embodiments, the scoring machine 10 and the associated modules on the computer 6 can monitor the voltages, currents, or other parameters on each wire. In such situations, they can indicate when there appears to be an erroneous short-circuit. For example, if a fencer's lamé 2A receives power when his own sword 1A is activated, this likely indicates that the two are erroneously electrically connected. This can cause the result that when his opponent's sword 1B contacts his sword 1A (e.g., when parried) the lamé 2A will nevertheless receive power and possibly indicate a hit. In some embodiments the computer 6 can indicate this seemingly erroneous connection, suggesting correction prior to an error during competition. In some embodiments, this can be monitored by only looking for a threshold voltage, current, or the like. However, this problem can arise gradually (e.g., as sweat gradually develops and builds a connection across pieces of equipment), and so in some embodiments it may be advantageous to see the problem in advance by indicating the strength of the connection.

In further embodiments, the competitors can have the ability to input certain commands to the scoring machine 10 and the computer 6 with their fencing equipment. In some embodiments, the completion of circuits that would not be completed in normal competition can indicate a command to the scoring machine 10 or the computer 6. Erroneous commands can be more confidently avoided in some embodiments by requiring this circuit be held for an extended period of time For example, in some embodiments a command can be inputted by touching one's sword 1 to one's own lamé 2 for an extended period of time. In further embodiments, a command can be inputted by pressing the tip of one's sword 1A against the bell guard of an opponent's sword 1B for an extended period of time. In further embodiments, a command can be inputted by pressing the tip of one's sword 1 against an electrically conductive strip 3 for an extended period of time. In further embodiments, two extended and shortly-separated hits can indicate a command. In further embodiments, a rapid succession of completed-uncompleted circuits can indicate a command. These actions can produce a variety of results such as adding or subtracting points, starting or stopping a bout, or the like, without requiring use of another input device In even further embodiments, the operation of the scoring machine 10 and the computer 6 can be even further customized. For example, a variety of the features described herein, when included, can optionally be turned on or off. Thus, for example, one can deactivate modules that automatically detect what form of weapon is attached. This may be valuable, for example, where present competitors have a tendency to leave their sword tip depressed (possibly indicating to the module that a different weapon is attached).

In even further embodiments, the computing device 6 can be made integral with the scoring machine 10. In such embodiments, one can provide one or more display and/or data inputs/outputs to the computing device 6, such that it can output to a display, receive commands, and be reprogrammed (if so desired).

The various devices, methods, procedures, and techniques described above provide a number of ways to carry out the invention. Of course, it is to be understood that not necessarily all objectives or advantages described may be achieved in accordance with any particular embodiment described herein. Also, although the invention has been disclosed in the context of certain embodiments and examples, it will be understood by those skilled in the art that the invention extends beyond the specifically disclosed embodiments to other alternative embodiments and/or uses and obvious modifications and equivalents thereof. For example, some embodiments may include certain features or modules described herein, while other embodiments might not. Further, although the embodiments described herein are directed primarily to the sport of fencing, other embodiments can apply similar devices and modules to other sports. Accordingly, the invention is not intended to be limited by the specific disclosures of preferred embodiments herein.

What is claimed is:

1. A system adapted for scoring fencing matches comprising:

a scoring machine configured to alternately provide electrical power to a first sporting equipment and a second sporting equipment, the scoring machine comprising:

one or more first inputs configured to receive at least one first electrical signal indicative of a state of the first sporting equipment, wherein the first sporting equipment comprises at least a first electrical fencing sword;

one or more second inputs configured to receive at least one second electrical signal indicative of the state of a second sporting equipment, wherein the second sporting equipment comprises at least a second electrical fencing sword;

a processing unit communicatively coupled to the one or more first inputs and the one or more second inputs and configured to:

iteratively receive at least one third electrical signal comprising at least one of the at least one first electrical signal and the at least one second electrical signal and store said at least one third electrical signal in a memory; and at least one data output configured to transmit said at least one third electrical signal received by said processing unit as a block of data to a general-purpose computer, wherein the general-purpose computer is communicatively coupled to the data output and configured to receive said block of data, process said block of data, and indicate an appropriate sport-relevant result.

2. The system of claim 1, wherein the block of data includes substantially all of the information of the at least one third electrical signal.

3. The system of claim 1, wherein the data output comprises a data transfer interface compatible with standard general-purpose computers.

4. The system of claim 1, wherein at least one of the scoring machine and the general-purpose computer is configured to detect a type of fencing sword that forms at least a portion of at least one of the first sporting equipment and the second sporting equipment.

5. The system of claim 1, wherein at least one of the scoring machine and the general-purpose computer is configured to detect one or more characteristics of the sporting equipment.

6. A system adapted for scoring fencing matches comprising:

a scoring machine comprising:

at least one first input configured to receive at least one first electrical signal indicative of a state of a first sporting equipment;

at least one second input configured to receive at least one second electrical signal indicative of a state of a second sporting equipment;

a processing unit communicatively coupled to the at least one first input and the at least one second input and configured to receive at least one third electrical signal comprising at least one of the at least one first electrical signal and the at least one second electrical signal, and to process said at least one third electrical signal into a block of data; and at least one data output, configured to transmit said block of data to a general-purpose computer communicatively coupled to the scoring machine, wherein the general purpose computer is configured to receive said block of data and translate the block of data into an appropriate sport-relevant result, wherein the scoring machine is configured to alternately provide electrical power to the first sporting equipment during a first time interval and to provide electrical power to the second sporting equipment during a second time interval distinct from the first time interval.

7. The system of claim 6, wherein the block of data includes substantially all of the information of the at least one third electrical signal.

8. The system of claim 6, wherein at least one of the first sporting equipment and the second sporting equipment comprises at least an electrical fencing sword.

9. The system of claim 6, wherein the at least one third electrical signal indicates the status of one or more electrical circuits being open or closed within at least one of the first sporting equipment and the second sporting equipment.

10. The system of claim 6, wherein the at least one data output comprises a data transfer interface compatible with standard general-purpose computers.

11. A device for facilitating the scoring of a fencing match comprising:

a first fencing cord input;

a second fencing cord input;

a standardized general-purpose computer output;

a processing module in communication with the first and second fencing cord inputs, and the standardized general-purpose computer output, the processing module configured to:

alternately apply power to at least a portion of the first fencing cord input and at least a portion of the second fencing cord input at different times, check for fencing-relevant completed circuits between the fencing cord inputs, and output raw data regarding the completed circuits through the standardized general-purpose computer output.

12. The device of claim 11, wherein the device comprises a third input for connection to a fencing piste.

13. The device of claim 11, further comprising a memory configured to hold data regarding the completed circuits, wherein the processing module is further configured to transmit said data as a block of data through the standardized general-purpose computer output.

14. A method of scoring a fencing match, comprising:

alternately applying electrical power to a plurality of fencing-relevant circuits at different times;

monitoring the status of the plurality of fencing-relevant circuits using a first scoring device;

storing the status of said plurality of fencing-relevant circuits using said first scoring device;

transmitting one or more stored statuses to a general-purpose computer in a block of data;

converting the block of data into a fencing-relevant result using said general-purpose computer; and displaying said fencing-relevant result.

15. The method of claim 14, wherein alternately applying electrical power comprises providing electrical power to cords associated with one or more fencing competitors.

16. The method of claim 14, further comprising checking for a lost signal at the general-purpose computer.

17. The method of claim 14, further comprising detecting a type of fencing sword communicatively connected to the first scoring device.

18. The method of claim 14, further comprising choosing a set of rules for a fencing match that deviate from a preprogrammed set of rules immediately before said fencing match.

* * * * *